United States Patent [19]

Stevenson

[11] 4,067,500

[45] Jan. 10, 1978

[54] APPARATUS FOR CONVEYING FLUID FROM A LOWER LEVEL TO AN ELEVATED LEVEL

[75] Inventor: Richard Michiel Stevenson, Newark, England

[73] Assignee: Kendrick Stevens Limited, England

[21] Appl. No.: 702,902

[22] Filed: July 6, 1976

[51] Int. Cl.[2] ..... B05B 1/14

[52] U.S. Cl. ..... 239/556; 239/588; 417/572

[58] Field of Search ..... 222/416; 239/588, 302, 239/195, 589, 556; 417/572

[56] References Cited

U.S. PATENT DOCUMENTS 2,954,736 10/1960 Garland ..... 417/572

3,940,065 2/1976 Ware ..... 239/302 X

*Primary Examiner*—Richard A. Schacher

*Attorney, Agent, or Firm*—Diller, Brown, Ramik & Wight

[57] ABSTRACT

Apparatus for conveying fluid from a lower level to an elevated level comprising a flexible fluid conveying tube having at one end a one way valve of simple construction and at the other end a dispensing head. In use the valve is placed below the surface of the fluid at the lower level and the dispensing head is oscillated to cause conveyance of fluid along the tube. Anchoring means are provided for maintaining the valve below the surface of the fluid at the lower level irrespective of the degree or vigorosity of oscillation of the dispensing head.

9 Claims, 5 Drawing Figures

APPARATUS FOR CONVEYING FLUID FROM A LOWER LEVEL TO AN ELEVATED LEVEL

The present invention relates to an improved apparatus for conveying fluid from a lower level to an elevated level.

According to the teaching of U.K. patent specification No. 890,052 it is known to provide an apparatus for conveying liquid from a lower level to a higher level which apparatus includes a flexible fluid conveying tube having at one end a dispensing head in the form of a washing brush and at the other end a one way valve.

The apparatus disclosed in U.K specification No. 890,052 has a major drawback in that it does not reliably function in use. One of the reasons for this is that in order to convey fluid from a lower level to a higher level, the end of the tube is placed below the surface of the fluid in the fluid at the lowest level and the washing brush head is oscillated in a gyratory fashion; such motion causes fluid to flow up the flexible tube to be discharged from the washing brush. The faster the motion, the faster the rate of discharge of the fluid. However, such motion also causes movement of the end of the tube at which the valve is located and consequently, unless the operative is very careful the valve rises above the surface of the fluid at the lower level and air is drawn into the tube. This is particularly undesirable as the apparatus ceases to function once air is so admitted.

Accordingly, the rate at which the operative moves the washing head has to be fast enough to obtain a sufficient rate of fluid discharge from the washing head and slow enough so as not to cause excessive movement of the valve.

These two requirements are not always compatible particularly in the case where say, the fluid at the lower level is contained in a container, such as a bucket. If the valve is located just above the bottom of the container and the container is full, then as the washing head is oscillated, the fluid level drops. Consequently, the closer the fluid level comes to the valve the more critical is the allowed degree of movement of the valve. Accordingly, once the fluid level is just above the fluid level, then the slightest upward movement of the valve may be sufficient to lift the valve above the fluid level to draw in air.

Another drawback with the apparatus disclosed in U.K. specification 890,052 is that the valve is complicated in construction and thus expensive to produce.

The housing of the known valve is made from metal components and in consequence the valve is heavy. This is undesirable from the point of view of packaging and transportation and also undesirable for the operative.

An object of the present invention is to provide an improved apparatus for conveying fluid from a lower level to a higher level.

Another object of the present invention is to provide an apparatus for conveying fluid from a lower level to a higher level having a flexible tube having a dispensing head at one end and a one way valve at the other end, the valve being light in weight, simple in construction and cheap to produce.

An embodiment according to the invention is hereinafter particularly described with reference to the accompanying drawings, in which.

Figure 1:
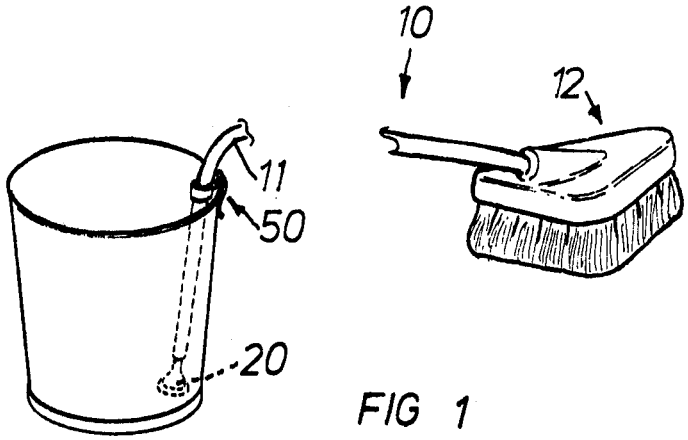
FIG. 1 is a perspective view of an apparatus according to the present invention.
Figure 2:
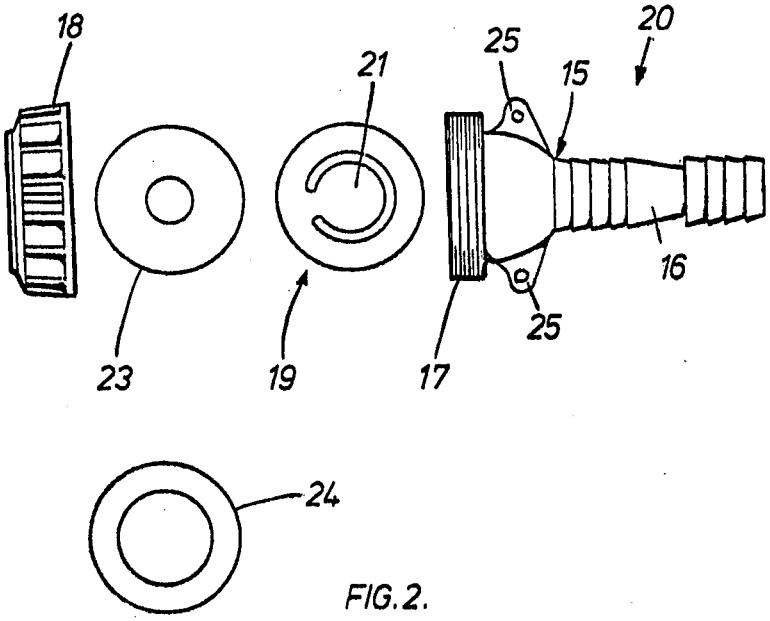
FIG. 2 is an exploded view of the valve assembly of FIG. 1.
Figure 3:
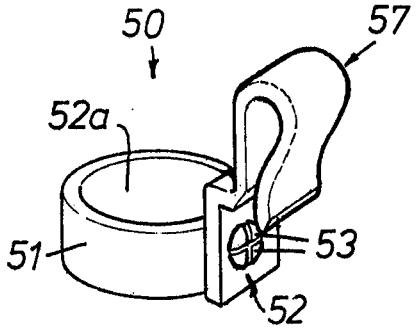
Figure 3A:
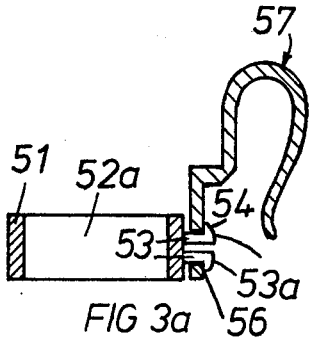

FIGS. 3, 3*a* are a perspective view and cross-sectional view respectively of the clip used in FIG. 1.

Figure 4:
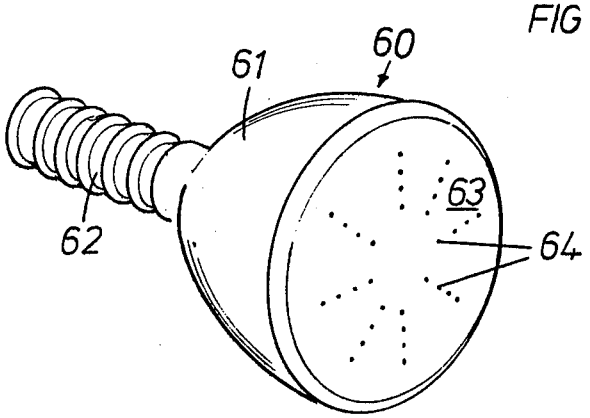

FIG. 4 is a perspective view of a sprinkling rose for use as with the apparatus of FIG. 1.

Referring to the drawings, the apparatus according to the present invention is generally shown at 10. The apparatus 10 comprises a one way valve 20 attached to one end of a flexible tube 11 and a dispensing device for instance, as shown in FIG. 1, a water spraying brush 12 connected to the other end of the tube. The dispensing device may alternatively be a spray nozzle as shown in FIG. 4.

The valve 20 comprises a housing 15 which is a one piece moulding including an integrally formed tapered end portion 16 capable of receiving one end of tube 11. The housing 15 has a peripheral threaded portion 17 which threadedly receives a cap 18. The cap 18 has an aperture (not shown) which forms the inlet of the valve 20, the outlet being in communication with the tube 11.

Interposed between the cap 18 and housing 15 is a valve element 19 having a flap portion 21. The valve element 19 is formed from a resilient material for instance, a suitable plastics material or a suitable elastomer such as rubber. In use the flap portion 21 is co-operable with the cap 18 to permit fluid to enter the valve 20 through the aperture in cap 18 only and not permit fluid to exit from the valve 20 via the aperture in cap 18.

A washer 23 may be interposed between the cap 18 and the valve element 19, so that the valve element is co-operable with the washer 23 to permit flow of fluid into the housing through the aperture in the cap and prevent flow of fluid out of the housing through the aperture in the cap. An additional washer 24 may be interposed between the valve element 19 and the housing 15 to enhance support of the valve element in the valve 20. The component parts of the valve 20, except the valve element 19, may be cheaply formed from any plastics material or suitable reinforced resin having a greater rigidity than the valve element 19. In use, the tube is primed conveniently with the fluid which is to be transferred, i.e. filling the tube with fluid so as to expel air contained in the tube.

The valve 20 is then placed in a receptacle containing the fluid which is to be transferred and may be located in the receptacle by anchoring means in the form of a clip as seen in FIGS. 1 and 3.

The clip 50 comprises a tube engaging portion 51 which is generally annular in shape and which has a outwardly radially extending projection 52. The diameter of the bore 52 of the tube engaging portion is such as to frictionally receive the flexible tube 11. The projection 52 is defined by a plurality of outwardly directed fingers 53 which together form a shaft, each finger 53 is deflectable inwardly toward the axis of the shaft and each has an enlarged terminal end **53*a* which defines a shoulder 54**.

The projection 52 is received in an aperture 56 formed in one arm of a generally U-shaped clip member 57. The size of the aperture 56 is such as to permit the shaft or projection 52 to rotate therein but axial removal thereof is restrained by virtue of the shoulders 54 of the fingers 53 cooperating with the wall surrounding the aperture 56.

Both the tube engaging portion and clip member are one piece mouldings from a suitable plastics material such as polypropylene. The tube engaging portion and clip member are easily connected to one another by inserting the projection 52 through the aperture, whereupon the fingers 53 are inwardly deflected until their shoulders emerge from the opposite side of the aperture. The fingers then move outwardly under their inherent bias and the shoulders 54 thereafter restrain axial removal of the projection as described above.

Before operating the apparatus the clip is attached to the receptacle or container by pressing the clip member over an upper edge of a side wall of the container.

In order to draw fluid from the receptacle the dispensing device is generally oscillated from side to side or moved in a generally elipsoid or circular path. On moving the dispensing device in such manner, fluid is drawn from the receptacle and emitted from the dispensing device. It has been found that the faster the motion, the greater the rate of drawing fluid.

By virtue of the fact that the clip is held on the side wall of the container and that the tube engaging portion functionally engages the tube, the portion of the tube below the clip is restrained from axial movement irrespective of how quickly the washing head is moved. Kinking of the tube in the vicinity of the clip is restrained by virtue of the fact that the tube engaging portion is permitted to rotate relative to the clip members.

It is envisaged that such an apparatus has several uses for instance in the case of the dispensing device being a spraying brush the apparatus may be used to wash objects or surfaces such as vehicles or walls.

The apparatus is particularly convenient for washing motor vehicles such as cars since the operative merely places a receptacle containing soapy water, for instance a bucket, on the ground adjacent the car to be washed and using the device draw up the soapy water on the vehicle during brushing motions of the spraying brush 12. The vehicle may then be similarly rinsed using water.

Also it is envisaged that the apparatus may be used for painting such as white washing walls or for merely transferring fluid from one receptacle to another.

Advantageously, a boat may be hosed or brushed down using the present apparatus, the valve 20 being located in the surrounding water. In this connection, the housing 15 is provided with apertured lobes 25 to which weights may be attached for restraining the valve 20 from rising to the surface of the surrounding water. In this instance, the clip 50 is conveniently attached to the boat at a suitable place so that movement of the dispensing head is restrained from causing a lifting motion of the valve 20. It is envisaged that the cap 18 may be provided with a filter (not shown) to prevent debris and small objects from entering the apparatus.

As shown in FIG. 4, the dispensing head may be in the form of a sprinkling hose 60 which may be used for watering of plants. The hose 60 has a body 61 having an extension portion 62 for receiving the flexible tube. The body is conveniently a one-piece plastics moulding from a suitable plastics material, such as polypropylene. The body 61 has a mouth 62 in which an apertured plate member 63 is received. If has been found that the size of the apertures 64 is important bearing in mind that if the apertures are too large insufficient pressure is built up in the tube to provide a spray and also that if the apertures are too small, insufficient fluid is discharged. Accordingly it has been found that the apertures should be about 1/32 in diameter.

Plate member 63 is also conveniently a one piece plastics moulding from a suitable plastics material, for example polypropylene. Conveniently the mouth of the body 61 is provided with a circumferentially extending groove into which the peripheral edge of plate member 63 may be received.

What is claimed is:

1. An apparatus for conveying a fluid from a lower level to an elevated level comprising a flexible tube, a one way valve located at one end of the tube, the one way valve comprising a one-piece housing, a cap releasable received on the housing, the cap having an aperture forming the inlet of the valve, and valve means located between the cap and the housing and being operable only to permit flow of fluid into the housing through the aperture, the housing being integrally formed with an end portion for receiving the tube, a dispensing device located at the other end of the tube, the arrangement being such that, on movement of the dispensing device relative to the opposite end of the tube when received in the fluid, fluid is drawn into the tube and emitted from the diepensing device and anchoring means for maintaining the valve means below the surface of the fluid to be conveyed, said anchoring means including a tube engaging portion which frictionally receives the tube and clip means for attachment to a receptacle or frame, the tube engaging portion being rotatably received in the clip means, and said tube engaging portion being annular in shape and having a bore for frictionally receiving the flexible tube, said tube engaging portion further having a radially outwardly extending projection for rotatable reception in an aperture formed in the clip means.

2. An apparatus as defined in claim 1 wherein the projection is in the form of a shaft formed by a plurality of radially outwardly extending side by side fingers, each finger being deflectable inwardly toward the axis of the shaft.

3. An apparatus as defined in claim 2 wherein each finger has an enlarged terminal portion which defines a shoulder, the shoulders cooperating with the wall of the clip means surrounding said aperture to restrain axial removal of the shaft.

4. An apparatus as defined in claim 3 wherein the clip means is a clip member of generally U-shape, said aperture being formed in one of the arms of the clip member.

5. An apparatus as defined in claim 4 wherein the valve means comprises a valve element having a flap portion which normally closes the aperture in the cap and serves to permit fluid to flow into the housing through the aperture and prevent fluid from flowing out of the housing through the aperture.

6. An apparatus as defined in claim 5 wherein a washer is interposed between the cap and the housing, the valve element being co-operable with the washer to permit flow of fluid into the housing through the aperture in the cap and prevent flow of fluid out of the housing through the aperture in the cap.

7. An apparatus as defined in claim 6 wherein the dispensing device is a spraying brush.

8. An apparatus as defined in claim 6 wherein the dispensing device is a spraying rose.

9. An apparatus as defined in claim 8 wherein the spraying rose includes a plate member having apertures formed therein, the diameter of the apertures being about 1/32 inches.

* * * * *